US012203041B2

(12) United States Patent
Bonifacio

(10) Patent No.: US 12,203,041 B2
(45) **Date of Patent: *Jan. 21, 2025**

(54) GROUND OR UNGROUND RICE HUSK USED AS FUEL FOR GLASS, GLAZE AND SIMILAR FURNACES AS A SUBSTITUTE FOR FOSSIL FUELS

(71) Applicant: Dennis Ricardo Ribeiro, Taboão Mogi das Cruzes (BR)

(72) Inventor: Enrique Ruben Bonifacio, Taboão Mogi das Cruzes (BR)

( * ) Notice: Subject to any disclaimer, the term of this patent is extended or adjusted under 35 U.S.C. 154(b) by 0 days.

This patent is subject to a terminal disclaimer.

(21) Appl. No.: 18/232,151

(22) Filed: Aug. 9, 2023

(65) Prior Publication Data

US 2024/0093110 A1 Mar. 21, 2024

(30) Foreign Application Priority Data

Aug. 9, 2022 (BR) ..... 102022015713-8

(51) Int. Cl.
*C10L 5/44* (2006.01)

(52) U.S. Cl.
CPC ..... *C10L 5/445* (2013.01); *C10L 2290/08* (2013.01); *C10L 2290/28* (2013.01)

(58) Field of Classification Search
CPC .. C10L 5/445; C10L 2290/08; C10L 2290/28; C10L 2290/143; C10L 2290/145; C10L 2290/148; C10L 2290/52
USPC ..... 44/505
See application file for complete search history.

(56) References Cited

U.S. PATENT DOCUMENTS

| | | | | |
|---|---|---|---|---|
| 11,311,835 | B1 * | 4/2022 | Mohammad | B01D 53/82 |
| 2002/0056937 | A1 * | 5/2002 | Kim | B29C 43/003 264/109 |
| 2010/0199550 | A1 * | 8/2010 | Chen | C10L 5/44 44/530 |
| 2011/0159580 | A1 * | 6/2011 | Kim | B01D 53/58 502/402 |
| 2013/0136683 | A1 * | 5/2013 | Paskalov | C10B 19/00 422/186.04 |
| 2015/0007492 | A1 * | 1/2015 | Piriou | C10L 5/44 44/500 |
| 2019/0293283 | A1 * | 9/2019 | Di Felice | F23G 5/38 |
| 2021/0237031 | A1 * | 8/2021 | Basheer | B01J 20/28083 |
| 2021/0332304 | A1 * | 10/2021 | Bai | C10L 9/083 |
| 2021/0332305 | A1 * | 10/2021 | Bai | C10L 5/442 |
| 2022/0033727 | A1 * | 2/2022 | Bai | F23K 1/00 |

* cited by examiner

*Primary Examiner* — Ellen M McAvoy
(74) *Attorney, Agent, or Firm* — B. Aaron Schulman, Esq.; Stites & Harbison, PLLC

(57) ABSTRACT

A process for using Rice Husk residue as an alternative fuel to fossil fuels (such as Natural Gas and LPP oils 1 A . . . 9 A), in the combustion chamber of the glass, glaze or similar furnace. Where a waste is collected in dump trucks and unloaded into a proper silo, then passes through a dryer feeding silo where it is atomized in the kiln combustion chamber, a high-pressure, low-flow fan is used to atomize it, along with all the necessary air, which can be used in oxy-combustion kilns; all the combustion gases are cooled by mixing with cold air and the incandescent gas from the kiln; and they are then collected and passed through a sleeve filter for proper filtration.

12 Claims, 5 Drawing Sheets

GROUND OR UNGROUND RICE HUSK USED AS FUEL FOR GLASS, GLAZE AND SIMILAR FURNACES AS A SUBSTITUTE FOR FOSSIL FUELS

FIELD OF THE INVENTION

The present invention deals with the use of ground or unground rice husk waste as an alternative to the use of Natural Gas and LPP oils 1 A . . . 9 A in a furnace for glass, glaze, etc.

BACKGROUND OF THE INVENTION

Rice husk is collected in dump trucks and unloaded into a suitable silo, specifically built for this purpose. It is then transferred to a Dryer Feed Silo, where it is dried. If it is ground, it goes through a grinding and classification system before being atomized in the combustion chamber of the Furnace.

Currently, there is a significant production of Methane Gas in the fields where Rice Husk is disposed of, and since it is a hardly degradable residue (nature takes approximately ten years to incorporate it into the soil), the use of Rice Husk as an alternative fuel becomes highly feasible for addressing this waste issue.

DETAILED DESCRIPTION OF THE INVENTION

Figure 1:
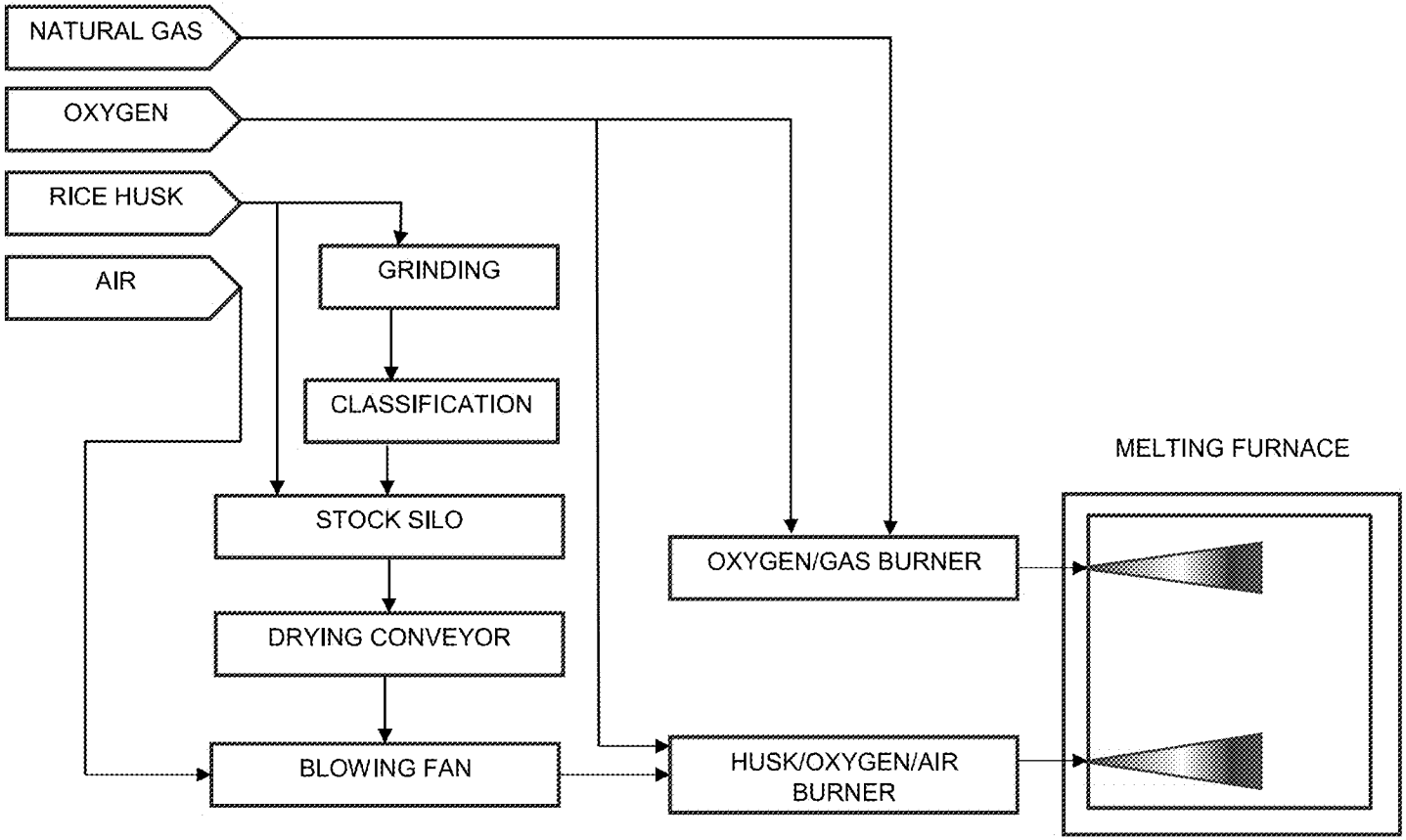
FIG. 1 provides an overview of the process, describing in a macro sense the fuels used in the system, the main equipment, and the final destination of each material used in the burning process of ground or unground Rice Husk.
Figure 2:
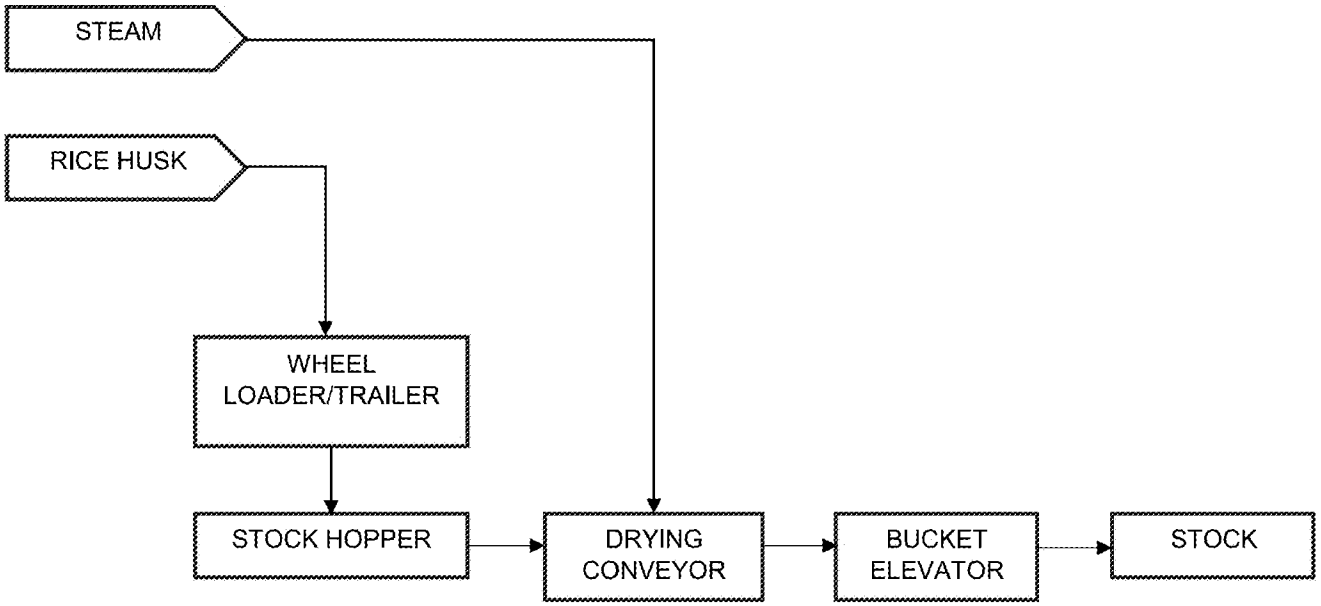
FIG. 2 displays in detail the arrival of rice husk at the storage point, demonstrating its path from entering the factory plant to the pre-drying process, which takes place during the transfer of the husk to the storage silo.
Figure 3:
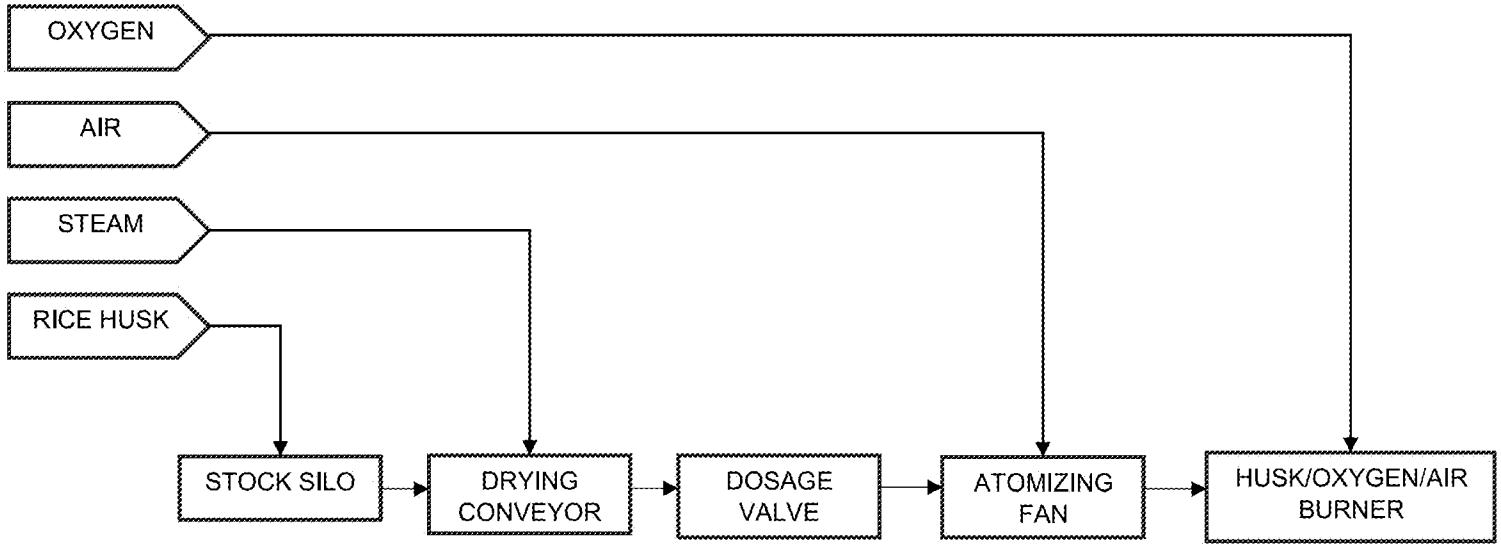
FIG. 3 demonstrates the path of ground or unground rice husk from the storage silo to the drying conveyor, which will perform the final drying process using vaporized heating. This process removes moisture residues and feeds the atomizer fan that directs the fuel to the rice husk/$O^2$/air burner.
Figure 4:
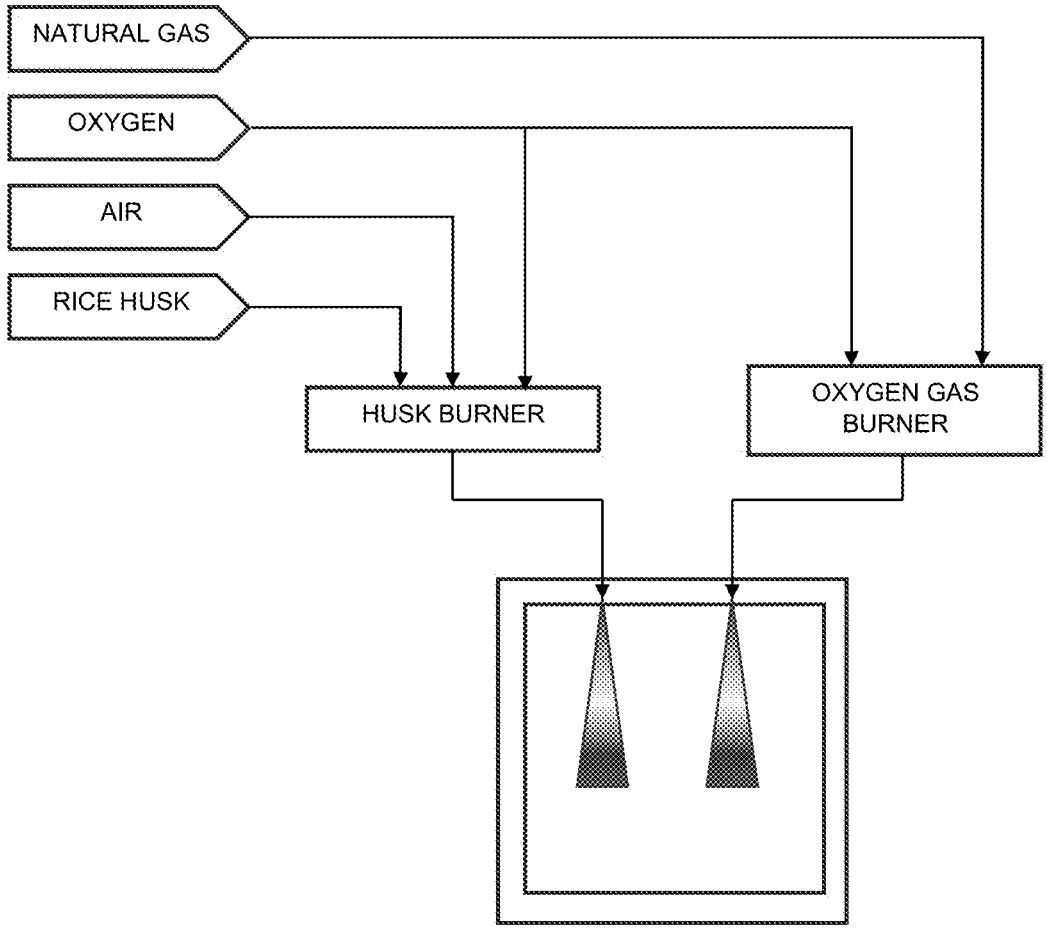
FIG. 4 shows that when ground rice husk is not used, contains information about the final combustion process of the fuels and oxidizers to be used in the process. It details the two combined burners (Oxy-gas and Rice Husk/$O^2$), the flow of feed in the pipelines, and their final destination in the Glass or Glaze Furnace to be used.
Figure 5:
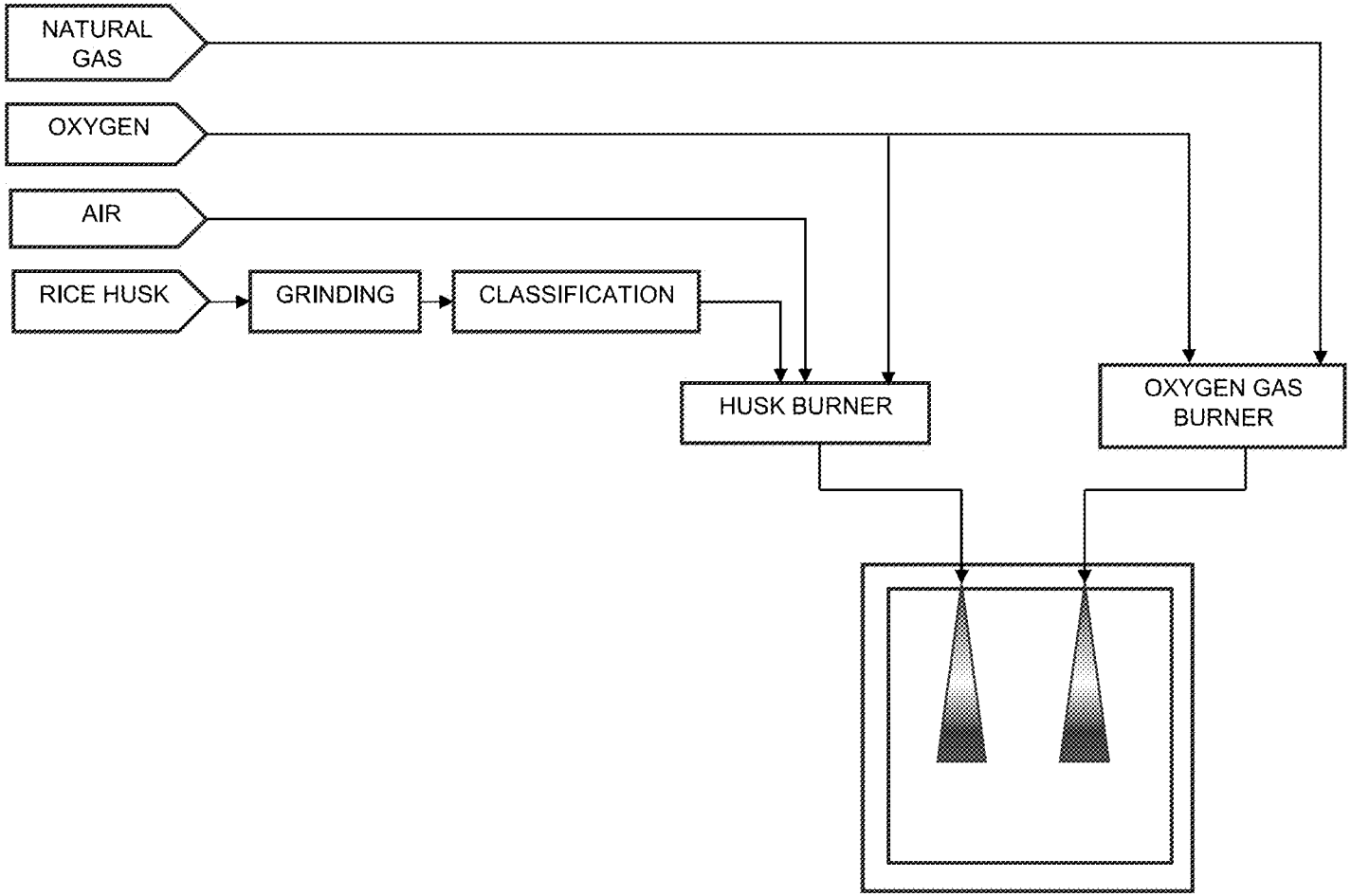
FIG. 5 shows that when ground rice husk is used, contains information about the grinding, classification, and final combustion process of the fuels and oxidizers to be used in the process. It details the two combined burners (Oxy-gas and Ground Rice Husk/$O^2$), the flow of feed in the pipelines, and their final destination in the Glass or Glaze Furnace to be used.

The Rice Husk Residue is ground or unground and dried, atomized in the Combustion Chamber of a Furnace, where combustion takes place, and when introduced into the Chamber at 1,300° C., it releases heat to the environment, thus maintaining the Chamber temperature.

To atomize it, we use a high pressure, low air flow fan, and all the air required for Combustion (Secondary air is supplied by a Low-Pressure Secondary Fan placed into the already preheated Chamber) can also be used in Oxy-Combustion furnaces. All Gas resulting from Combustion is cooled, normally by mixing Cold Air (Room) with Incandescent Gas, coming from the Furnace, and collected and passed through a sleeve filter to be properly filtered.

What currently exists, publicly known, is the use of residue in Biomass Boilers, which are equipment used for the generation of saturated or superheated steam. This use is limited because rice husk, being rich in SiO2, quickly forms deposits in the ducts and tubes of the Equipment, and therefore it should be used in small quantities.

Ground Rice Husk performs better than natural Rice Husk.

Example of Implementation of the Invention

The environmental benefit of this process is very significant, as instead of having a waste generating methane gas in the fields where it is disposed, and due to its slow degradation (it takes approximately ten years for Nature to incorporate it into the soil), which has been accumulating in alarming proportions, this process of using it as an alternative source to fossil fuels effectively accelerates the incorporation of the waste into the soil. What remains are inert ashes, rich in silicon and potassium, which enrich the soil. And the best part is that we are replacing fossil fuels in these casting processes.

What is claimed is:

1. A system for using ground or unground rice husk as fuel for a glass furnace as a substitute for fossil fuels, said system comprising a dryer, a storage silo, and a feeding system for the dryer, wherein the dryer comprises a grinding, classification, and atomization system capable of using rice husk as fuel, and wherein the ground or unground rice husk is stored in said storage silo and is ground in a grinder and then passed through fans and atomized in a combustion chamber of the glass furnace using combined burners in an oxygen-air burner.

2. The system for using ground or unground rice husk according to claim 1, wherein the ground or unground rice husk is used as an alternative fuel for industrial furnaces.

3. The system for using ground or unground rice husk according to claim 1, wherein the ground and unground rice husk is stored in said storage silo and transferred to a drying silo for dryer feeding.

4. The system for using ground or unground rice husk according to claim 1, further comprising pre-drying of the ground or unground rice husk occurs during transferring the ground or unground rice husk to a stock silo.

5. The system for using ground or unground rice husk according to claim 4, further comprising a discharge of the ground or unground rice husk from the storage silo to a drying conveyor to carry out a final drying process comprising vaporized heating, removing moisture residues, and feeding an atomizing fan which directs the ground or unground rice husk to said oxygen-air burner.

6. The system for using ground or unground rice husk according to claim 1, wherein the ground or unground rice husk undergoes a grinding and classification process after drying, but before said ground or unground rice husk is atomized in the combustion chamber of the glass furnace.

7. The system for using according to claim 5, wherein the final drying process further comprises oxidizers used in said oxygen-air burner.

8. The system for using ground or unground rice husk according to claim 1, further comprising a feed flow using pipes in the glass furnace.

9. The system for using ground or unground rice husk according to claim 1, wherein in said atomization process in the combustion chamber of said glass furnace, combustion occurs at 1,300° C. and heat is released in order to maintain the temperature of the combustion chamber.

10. The system for using ground or unground rice husk according to claim 1, further comprising use of a high pressure fan and low air flow rate to provide air required for combustion, and wherein the combustion chamber is preheated, and wherein a secondary air is supplied by a secondary low pressure fan placed into the preheated combustion chamber.

11. The ground or unground rice husk ground or unground according to claim 1, further comprises cooling of all combustion gases, mixing them with cold ambient air and the incandescent gas from said glass furnace, and then collecting and passing said combustion gases through a sleeve filter for filtration.

12. The ground or unground rice husk ground or unground according to claim 1, wherein said system is carried out in an oxy-combustion furnace.

* * * * *